US005517733A

United States Patent [19]

Chao

[11] Patent Number: 5,517,733

[45] Date of Patent: May 21, 1996

[54] NON-PINLOCK TYPE SLIDE FOR ZIP FASTENERS

[75] Inventor: Chao-Mu Chao, 2F, No. 14, Alley 11, Lane 123, Sec. 3, Jen Ai Rd., Taipei, Taiwan

[73] Assignees: Chao-Mu Chou, Taipei; Tu-Huo Chou, Chang Hua Hsien; Shiu-Yin Cheng, Tao Yuan Hsien, all of Taiwan

[21] Appl. No.: 358,181

[22] Filed: Dec. 16, 1994

[51] Int. Cl.[6] ..... A44B 19/00

[52] U.S. Cl. ..... 24/427; 24/428

[58] Field of Search ..... 24/427, 428, 410, 24/411, 413, 419, 429, 587

[56] References Cited

U.S. PATENT DOCUMENTS

| | | | |
|---|---|---|---|
| 2,079,722 | 5/1937 | Sundback | 24/427 |
| 2,370,059 | 2/1945 | Marinsky | 24/427 |
| 3,854,175 | 12/1974 | Yoshida | 24/427 |
| 4,071,928 | 2/1978 | Oda | 24/427 |

*Primary Examiner*—Victor N. Sakran
*Attorney, Agent, or Firm*—Bucknam and Archer

[57] ABSTRACT

A slide for a zip fastener including: a flat, rectangular base frame having a front and and a rear end of width smaller than the front end; a center guide plate of shape corresponding to the flat base frame but of relatively smaller size, connected in parallel to the base frame by a hemihedron support, defining with the flat base frame a space of height approximately equal to the height of the teeth of the zip fastener; two front wings raised from two opposite sides of the front end of the flat bottom frame and then turned inwards toward each other, defining with the flat base frame a respective front passage for passing the zipper tapes; and two rear wings raised from two opposite sides of the rear end of the flat bottom frame and then turned inwards toward each other, defining with the flat base frame a respective rear passage for passing the zipper tapes.

2 Claims, 2 Drawing Sheets

NON-PINLOCK TYPE SLIDE FOR ZIP FASTENERS

BACKGROUND OF THE INVENTION

The present invention relates to zip fasteners, and more specifically relates to a non-pinlock type slide for zip fasteners.

Various zip fasteners are well known and intensively used in garment, leather goods, etc. These zip fasteners include two types, namely, the close end zip fasteners and the open end zip fasteners. The open end zip fasteners are commonly used for closing the front panels of clothes. The close end zip fasteners are commonly used for closing bags, the back panels of clothes and skirts for ladies. Furthermore, different zip fasteners are equipped with different slides. For example, the slide of an open end zip fastener must have means to stop from sliding when the zip fastener is closed. The slide of a close end zip fastener also have to be equipped with a locking means. Regular slides for zip fasteners commonly have a pinlock, which is fastened to the springlock or autolock in the teeth of the zip fastener when the zip fastener is closed. Therefore, the base frame of the slide must made with a hole for the passing of the pinlock. Because of the arrangement of the pinlock, the thickness of the slide cannot be reduced to the satisfactory level. Furthermore, the arrangement of the pinlock complicates the assembly process of the slide.

There are also known invisible zip fasteners commonly used in clothes for ladies for the advantage of invisible when closed. However, regular invisible zip fasteners cannot be pulled to the top when closed. Therefore, additional fastening means must be used to close the clothe over the top end of zip fastener. This limitation complicates the manufacturing process of the clothes which use invisible zip fasteners.

SUMMARY OF THE INVENTION

The present invention has been accomplished to provide a slide for zip fasteners which eliminates the aforesaid drawbacks. According to the present invention, the slide for a zip fastener comprises a flat, rectangular base frame having a front and and a rear end of width smaller than the front end, a center guide plate of shape corresponding to the flat base frame but of relatively smaller size, connected in parallel to the base frame by a hemihedron support, defining with the flat base frame a space of height approximately equal to the height of the teeth of the zip fastener, two front wings raised from two opposite sides of the front end of the flat bottom frame and then turned inwards toward each other, defining with the flat base frame a respective front passage for passing the zipper tapes, and two rear wings raised from two opposite sides of the rear end of the flat bottom frame and then turned inwards toward each other, defining with the flat base frame a respective rear passage for passing the zipper tapes. The aforesaid structure of slide achieves the following advantages:

1) The slide is integrally molded from suitable material, and therefore the manufacturing process is simple and the manufacturing cost is low.
2) Because no pinlock is needed, the thickness of the slide can be reduced to the satisfactory level.
3) Because the two opposite ends of the center guide plate are made gradually smaller and the topmost sides of the front and rear wings are made fitting the periphery of the center guide plate, the slide does not slip on the zipper tapes of the zip fastener.
4) The design of the center guide plate and the front wings permits the slide to be pulled to the top end of the zip fastener, and therefore when the slide is used in an invisible zip fastener, the top end of the zip fastener can be completely concealed from sight.

DETAILED DESCRIPTION OF THE PREFERRED EMBODIMENT

Figure 2:
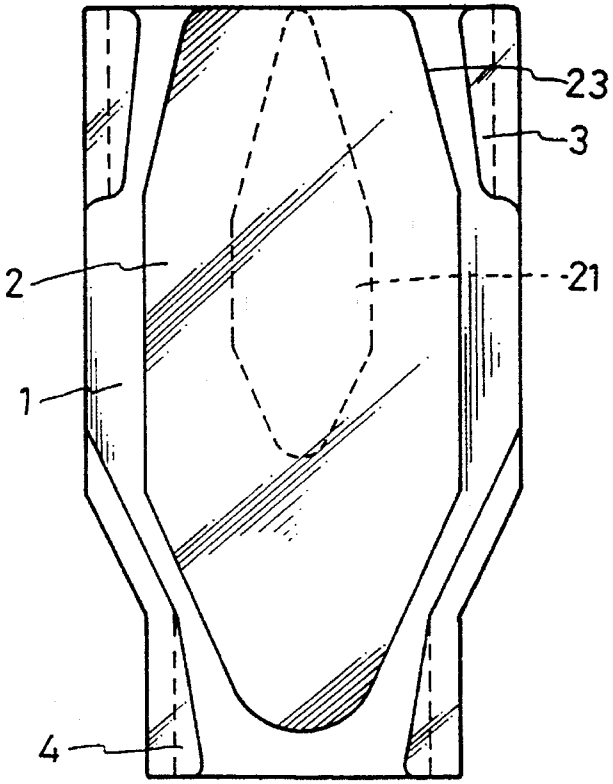
FIG. 2 is a top view of FIG. 1.
Figure 1:
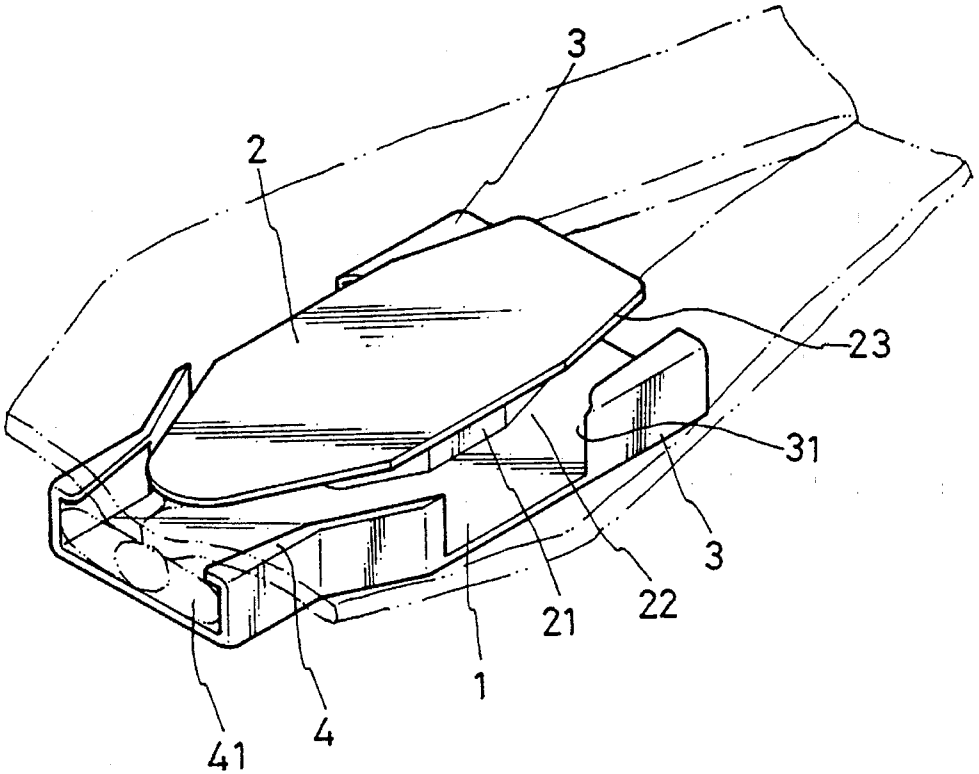
FIG. 1 is a perspective view of a slide according to the present invention.

Referring to FIGS. 1 and 2, a slide for a zip fastener in accordance with the present invention is made in integrity, comprised of a flat base frame 1, a center guide plate 2 longitudinally disposed inside the base frame 1, two opposite front wings 3 and two opposite rear wings 4 respectively raised from two opposite sides of the flat base frame 1. The flat base frame 1 is made of substantially rectangular shape for letting the teeth of the two opposite zipper tapes of the zip fastener to pass, having a pull tap (not shown) at the back side for pulling by hand. The width of the rear end of the flat base frame 1 is relatively smaller than that of the front end thereof. The center guide plate 2 is made of shape corresponding to the flat base frame 1 but of relatively smaller size, disposed in parallel with the flat base frame 1 and connected to the flat base frame 1 by a hemihedron support 21, defining with the flat base frame 1 a space 22 of height approximately equal to the height of the teeth of the zip fastener. The widths of the two opposite ends 23 of the center guide plate 2 are made gradually smaller toward reversed directions. The front wings 3 are perpendicularly raised from the two opposite sides of the front end of the flat bottom frame 1 and then turned inwards toward each other, defining with the flat base frame 1 a respective front passage 31 of height approximately equal to the height of the teeth of the zip fastener. The topmost width of each front passage 31 between the topmost side of one front wing 3 and the periphery of the center guide plate 2 is sufficient for allowing only one zipper tape of the zip fastener to pass. The width of the front passage 31 between one front wing 3 and the prism 21 is approximately equal to the length of the teeth of the zip fastener. Therefore, the zipper tapes of the zip fastener can be received in the space 22 and the front passages 31, and the slide can be smoothly moved along the zipper tapes of the zip fastener. The rear wings 4 are respectively raised from the two opposite sides of the rear end of the flat bottom frame 1 and then turned inwards toward each other, defining with the flat base frame 1 a respective rear passage 41 of height approximately equal to the height of the teeth of the zip fastener. The topmost width of each rear passage 41 between the topmost side of one rear wing 4 and the periphery of the center guide plate 2 is sufficient for allowing only one zipper tape of the zip fastener to pass. The width between one rear wind 4 and the prism 21 is approximately equal to the length of the teeth of the zip fastener. The slide is pulled upwards along the zipper tapes after the two zipper tapes have been respectively inserted into the front passages 31, the teeth of the zipper tapes fastened together at the rear passage 41, and therefore the zip fastener is closed.

Because the top sides of the two opposite front wings 3 are respectively turned toward the longitudinal center line of the slide, the two zipper tapes of the zip fastener are forward toward each other before they are fastened together. If the two opposite zipper tapes of the zip fastener are respectively stretched outwards, the direction of the pulling force is perpendicular to the closing direction of the zip fastener. Besides, the teeth of the zipper tapes are not continuously connected together but arranged in parallel. Therefore, the chain (closed teeth) will not be opened when the two opposite zip tapes of the zip fastener are respectively stretched outwards.

Figure 4:
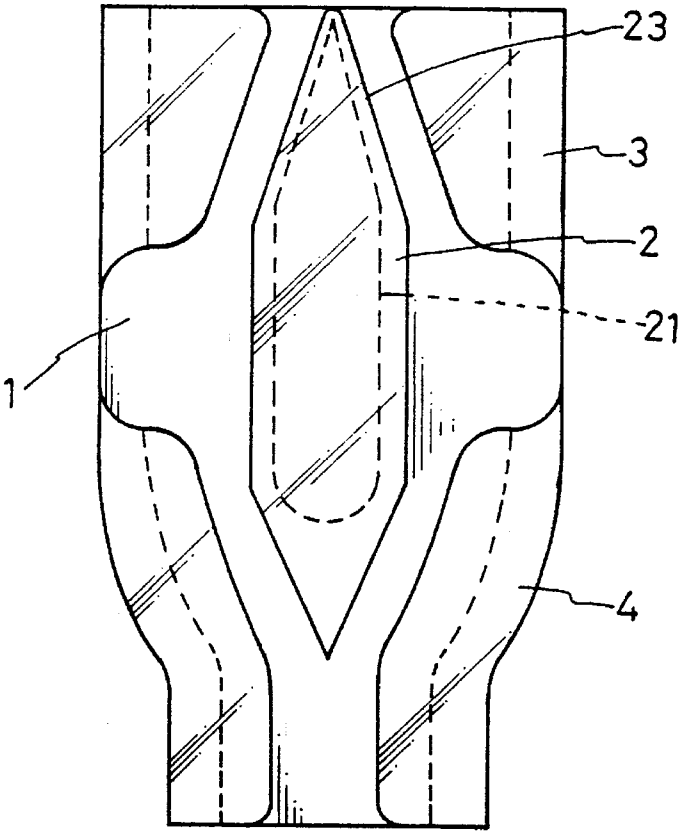
FIG. 4 is a top view of FIG. 3.
Figure 3:
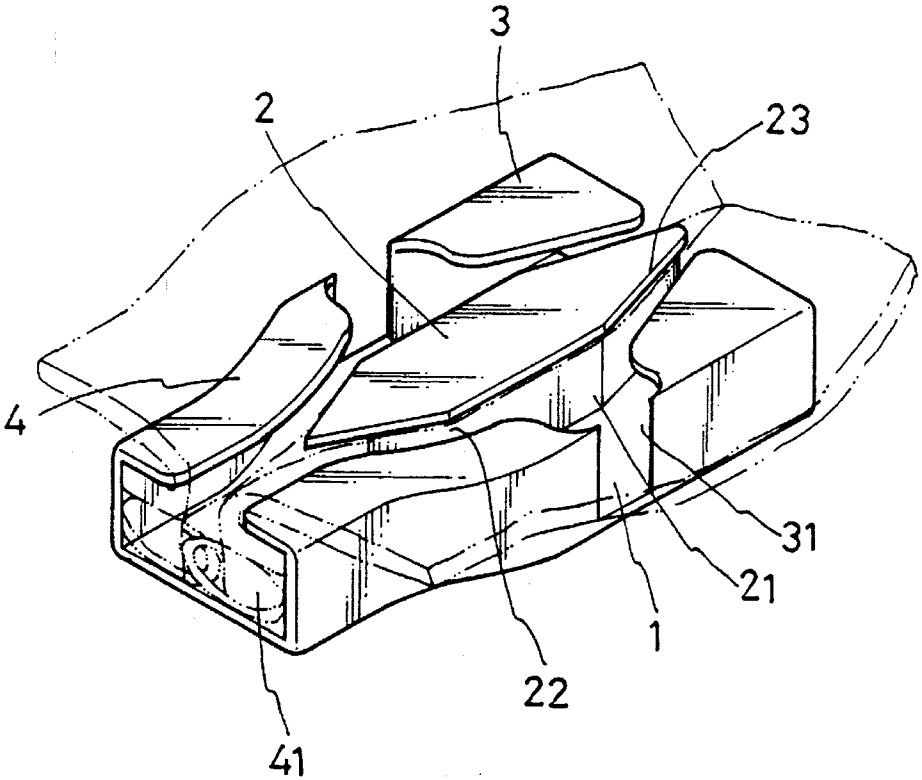
FIG. 3 is a perspective view of an alternate form of the present invention used in an invisible zip fastener.

FIGS. 3 and 4 show an alternate form of the slide used in an invisible zipper. The shape of this alternate form is slightly different from that shown in FIGS. 1 and 2, but the relative positions of the parts of this alternate form is similar to that Shown in FIGS. 1 and 2.

While only one embodiment of the present invention has been shown and described, it will be understood that various modifications and changes could be made without departing from the spirit and scope of the invention.

What is claimed is:

1. A slide for a zip fastener comprising:

a flat base frame made of substantially rectangular shape having a front end and a rear end of width smaller than said front end;

a center guide plate made of shape corresponding to said flat base frame but of relatively smaller size, disposed in parallel with said flat base frame and connected to said flat base frame by a hemihedron support, defining with said flat base frame a space of height approximately equal to the height of the teeth of the zip fastener, said center guide plate having two opposite ends made gradually smaller toward reversed directions;

two front wings perpendicularly raised from two opposite sides of the front end of said flat bottom frame and then turned inwards toward each other, defining with said flat base frame a respective front passage for passing the zipper tapes, the topmost width of each front passage between the topmost side of one wing and the periphery of said center guide plate being sufficient for allowing only one zipper tape of the zip fastener to pass; and two rear wings respectively raised from two opposite sides of the rear end of said flat bottom frame and then turned inwards toward each other, defining with said flat base frame a respective rear passage for passing the zipper tapes, the topmost width of each rear passage between the topmost side of one rear wing and the periphery of said center guide plate being sufficient for allowing only one zipper tape of the zip fastener to pass.

2. The slide of claim 1 wherein the heights of said front and rear passages are approximately equal to the height of the teeth of the zip fastener; the width of each front passage between one front wing and said prism and the width of each rear passage between one rear wing and said prism are approximately equal to the length of the teeth of the zip fastener.

* * * * *